United States Patent [19]

Everhart et al.

[11] 4,322,700

[45] Mar. 30, 1982

[54] ELECTRICAL RELAY APPARATUS

[75] Inventors: Billy M. Everhart, Pataskala; Harold E. McCullough, Blacklick, both of Ohio

[73] Assignee: Bell Telephone Laboratories, Incorporated, Murray Hill, N.J.

[21] Appl. No.: 105,923

[22] Filed: Dec. 21, 1979

[51] Int. Cl.[3] ..... H01H 50/26; H01H 51/29

[52] U.S. Cl. ..... 335/128; 335/187; 335/202

[58] Field of Search ..... 335/187, 195, 203, 121, 335/124, 127, 128, 131, 202, 196, 165, 200; 200/67 DB, 67 A, 67 D; 267/159

[56] References Cited

U.S. PATENT DOCUMENTS

| | | | |
|---|---|---|---|
| 2,599,437 | 6/1952 | Dickson | 200/67 |
| 2,658,972 | 11/1953 | Brown | 267/159 X |
| 3,067,301 | 12/1962 | Yamamoto | 200/67 |
| 3,109,901 | 11/1963 | Strauss | 200/67 |
| 3,209,095 | 9/1965 | Obszarny | 335/121 X |
| 3,284,594 | 11/1966 | Strauss | 200/67 |
| 3,501,722 | 3/1970 | Zwanen et al. | 335/202 X |
| 3,689,856 | 9/1972 | Lambert et al. | 335/133 |
| 3,699,296 | 10/1972 | Harris | 200/67 |
| 3,750,060 | 7/1973 | Pfenning | 335/135 |
| 3,873,078 | 3/1975 | Wolf | 267/159 |
| 4,002,871 | 1/1977 | Sims | 200/159 A |
| 4,190,751 | 2/1980 | Rothet al. | 200/67 |

*Primary Examiner*—L. T. Hix
*Assistant Examiner*—S. D. Schreyer
*Attorney, Agent, or Firm*—W. H. Kamstra

[57] ABSTRACT

Electrical relay apparatus in which a contact spring (35) is bowed rather than angularly flexed by the armature (16) to bring the contacts (28, 38, 34, 39) into or out of engagement. A first contact (38) is mounted at the crown of a slightly bowed spring (35) fixedly mounted at one end. The contact (38) is mounted at near the midpoint of the spring (35) spaced apart from a second, fixed contact (28) and the contacts (28, 38) are brought into engagement by the further bowing of the spring (35) by an armature (16) acting along the spring axis in the direction of its fixed end. A second contact (39) mounted on the underside of the spring (35) may be brought out of engagement with a second fixed contact (34) by the further bowing of the spring (35) for a break-before-make mode of operation.

7 Claims, 3 Drawing Figures

ELECTRICAL RELAY APPARATUS

TECHNICAL FIELD

This invention relates to electrical switch devices for selectively controlling the continuity of electrical circuits and particularly to electromechanical relays for performing this function.

BACKGROUND OF THE INVENTION

For many years, electromechanical relays have found wide and varied application in the telephone and related arts. Although recently solid state devices have replaced relays in many electronic and communications systems, relays still offer many advantages in terms of cost, reliability, and versatility, for example, in circuit applications where the highest operative speed is not a requirement. Relays have assumed a number of structural forms; conventionally, a relay construction contemplated here comprises an electromagnet, an armature, and a contact spring assembly, the armature being actuated to control the closing and/or opening of the contacts when the electromagnet is energized. The contact spring or springs are normally fixed at one end and are operated by an armature actuated card acting perpendicularly to the longitudinal axis of the springs at the other ends to deflect the ends into or out of electrical engagement with the opposing contacts.

Where relays are operated in conjunction with electronic devices, the reduction in physical size of the latter components has also dictated a miniaturization of the relays and a number of miniature relay forms are also known in the art. When relays are to be employed with printed circuit boards, for example, high packaging density requires that the relay present a minimum profile and mounting area. Other factors also significantly bear on the optimum design of a relay. Thus, problems of increasing operative speed, reducing power requirements, and simplifying its manufacture and adjustment to reduce cost, to name a few, are faced in the design of a relay construction intended for particular system applications and it is to these and other problems that the relay construction of the present invention is chiefly directed.

SUMMARY OF THE INVENTION

An improved relay construction in view of the aforementioned problems is realized and a technical advance is achieved in accordance with the principles of the invention in which a contact spring is bowed into engagement with the opposing contact by armature action directed along the longitudinal axis of the spring rather than by flexing action applied perpendicular to that axis. A spring contact is mounted at a midpoint crown of a slightly bowed spring fixedly mounted at one end. The contact is spaced apart from a second, opposing fixed contact and the contacts are brought into engagement by the further bowing of the spring by an armature acting along the longitudinal axis of the spring in the direction of the fixed end. In one embodiment, the further bowing of the spring disengages a second spring contact mounted on the opposite side of the spring from a second fixed contact to achieve a break-before-make operation. Advantageously, a relatively large spring contact movement is achieved as the result of a fraction of that movement by the relay armature, a mechanical advantage on the order of a multiplier of four having been achieved in practice. A feature of the relay construction is an armature arrangement in which the pole-piece air gap is minimized to achieve a significantly closer magnetic coupling.

BRIEF DESCRIPTION OF THE DRAWING

The organization and operation of an electrical relay construction according to the invention together with its advantages and features will be better understood from a consideration of the detailed description of one illustrative embodiment thereof which follows when taken in conjunction with the accompanying drawing in which.

DETAILED DESCRIPTION

Figure 1:
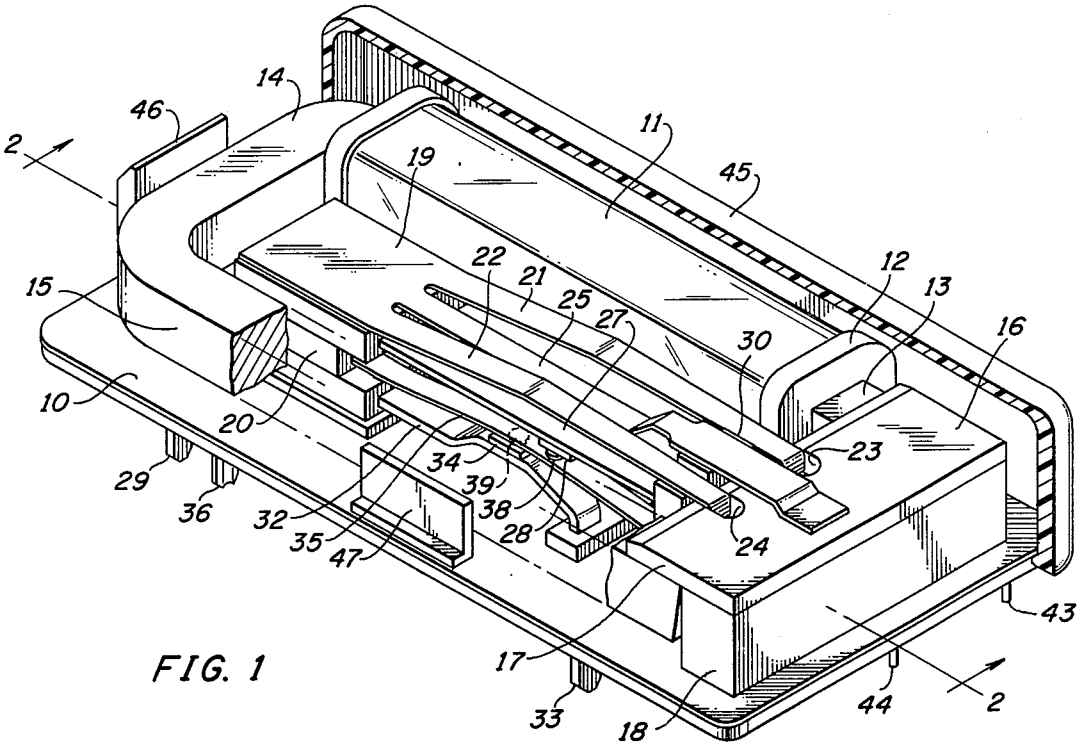
FIG. 1 depicts in perspective view one illustrative relay construction according to the invention with its enclosing cover and a portion of the pole-piece broken away to disclose various operative elements.
Figure 2:
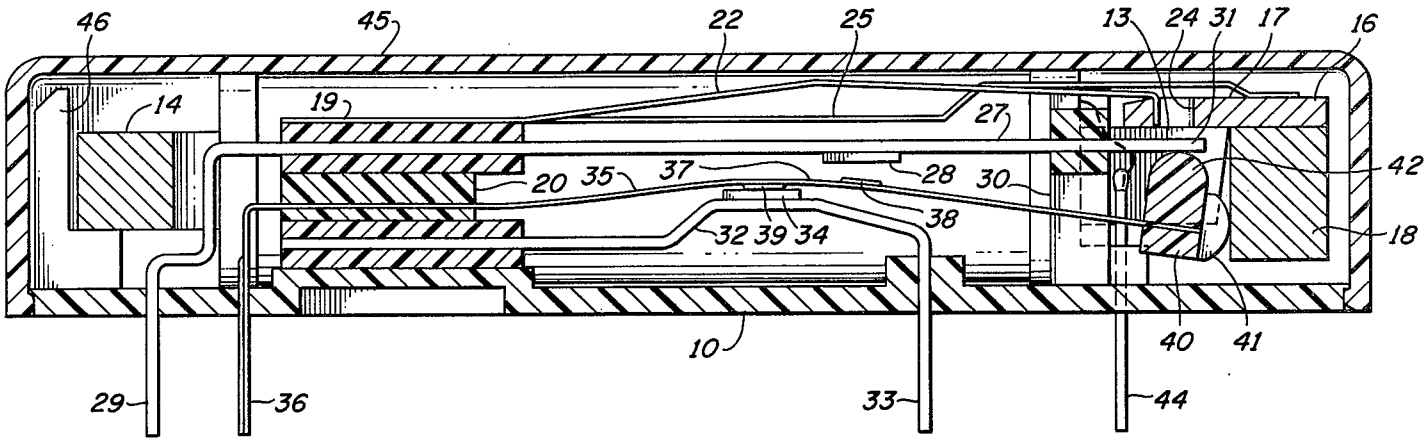
FIG. 2 is a section view of the relay construction of FIG. 1 taken along the line 2—2, the relay elements being shown in their unoperative state.

One illustrative relay construction according to the invention is shown in FIGS. 1 and 2 as comprising an insulative base 10 on which the operative elements are mounted. The more visible of the latter elements in FIG. 1 include a coil 11 the bobbin 12 of which encloses one leg 13 of a substantially "U" shaped pole-piece 14. The other leg 15 of pole-piece 14 is broken away more clearly to disclose the details of the contact spring assembly. A substantially "L" shaped armature 16 is arranged at the ends of pole-piece legs 13 and 15 in a manner so that one flange 17 rests on the upper surface of the pole-piece legs, the other flange 18 of armature 16 abutting closely against the ends of the pole-piece legs. Flange 17 is formed of a non-magnetic material and is affixed to magnetically responsive flange 18 in any convenient manner. The ends of pole-piece legs 13 and 15 are slightly canted to permit a clock-wise rotation of armature 16 about a pivot axis lying along the inner juncture of flanges 17 and 18 and the acute upper edges of legs 13 and 15. Armature 16 is maintained in a normal position against the ends of pole-piece legs 13 and 15 by a spring element 19 fixedly mounted at one end in a spring block 20 mounted in turn on base 10. Spring element 19 is formed to present a pair of outer arms 21 and 22 extending to flange 17 of armature 16. At that point the ends of arms 21 and 22 are bent downward 90 degrees to hook into a pair of apertures 23 and 24 provided in flange 17 of armature 16. Spring arms 21 and 22 in this manner hold armature 16 in abutment at the aforementioned pivot axis with the ends of pole-piece legs 13 and 15. Spring 19 is also formed to present a third, inner arm 25 also extending over the upper surface of flange 17 and stressed to exert a downward force on the latter flange. This spring force maintains and, as will be seen, restores armature 16 to a normal rotational position.

Spring block 20 also fixedly supports the ends of the circuit completion elements of the relay which include an upper spring 27 having a back contact 28 mounted on the underside thereof more clearly shown in FIG. 2. Spring 27 extends through block 20 and, after a 90 degree bend, further extends through base 10 to terminate in one relay terminal pin 29. At its other end spring 27 is fixedly supported by a slotted support member 30 through which it extends to terminate in an extension 31 for purposes which will become apparent hereinafter. A lower spring 32 is also fixedly supported at one end by block 20, the other end being formed to extend through relay base 10 to terminate in another relay terminal pin 33. Spring 32 carries on its upper surface a back contact 34. A final, third spring 35 is fixedly supported at one end by block 20 between springs 27 and 32 and extends therethrough and through base 10 to terminate in another terminal pin 36 of the relay. Spring 35 is bowed slightly upward to present a crown region 37 on the upper surface of which is mounted an electrical contact 38 located in spaced-apart opposition with contact 28 of fixed spring 27. On the under surface of spring 35 at another point in crown region 37 is mounted a second electrical contact 39 located to oppose contact 34 of spring 32, spring 35 being stressed to ensure engagement of contacts 34 and 39. Spring 35 extends through a slot in support member 30 and terminates at its other end in a rider member 40 fixedly mounted thereto visible in section only in FIGS. 2 and 3. Rider member 40 is formed to present a first rounded lobe 41 extending outwardly from the end of spring 35 along its longitudinal axis. Lobe 41 is dimensioned and adapted to slidably engage the inner surface of flange 18 of armature 16. Rider member 40 also presents a second rounded lobe 42 extending perpendicular to the afore-mentioned axis of spring 35 and adapted to slidably engage the undersurface of extension 31 of fixed spring 27. Although in the foregoing, the material of the various elements was not in every case indicated, the determination of the material to be employed, whether insulative, electrically conductive, magnetic, or nonmagnetic, is readily made by one skilled in the art in view of the functions of the elements to be described hereinafter. The organization of the illustrative relay construction being described is completed with a listing of a final set of terminal pins 43 and 44 which conventionally terminate the energizing circuit, not shown, for winding 11. An enclosing insulative cover 45, shown only in broken portion and in section in FIGS. 1 and 2 may conveniently be fitted to base 10 after assembly of the relay elements. In order to ensure proper alignment of and support for pole-piece 14, a rear back-stop 46 and a stop 47 at each leg 13 and 14 may be conveniently provided.

Figure 3:
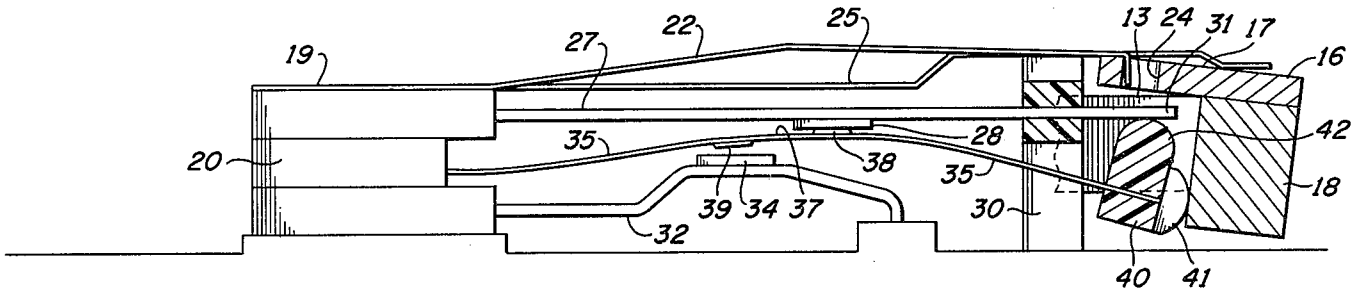
FIG. 3 is a simplified side view showing the relay elements in their operative state.

With the foregoing organization of an illustrative relay construction according to the invention in mind, typical operations thereof may now be considered. In FIG. 2, the elements of the relay are shown in their normal, unoperated state. In this state, a circuit is completed between terminal pins 33 and 36 via spring 32, its contact 34, contact 39 of spring 35, and spring 35 itself. The circuit between terminal pins 29 and 36 is open at the gap between contacts 28 and 38. When an appropriate energizing current is applied to winding terminal pins 43 and 44, a magnetic field generated by winding 11 induces a flux in pole-piece 14, a path for which closes between the ends of legs 13 and 15 and magnetically responsive flange 18 of armature 16. As a result, armature 16 is caused to rotate in a clock-wise direction as viewed in the drawing about the pivot axis at the juncture of flanges 17 and 18 to close the angled gap presented by the canted ends of pole-piece legs 13 and 15. This rotation is caused against the biasing action of spring arms 21, 22, and 25. As armature 16 rotates, rider member 40, lobes 41 and 42 of which are held between flange 18 and spring extension 31, is urged backwards in the direction of the fixed end of spring 35 substantially along the longitudinal axis of the latter. As a result, as shown in FIG. 3, the slight bow of spring 35 is extended initially to raise spring contact 39 from engagement with fixed contact 34. As the buckling of spring 35 continues, its contact 37 is brought into engagement with fixed contact 28 of spring 27. The previously closed circuit between terminal pins 33 and 36 is now open and the previously open circuit between terminal pins 29 and 36 is now completed. A break-before-make operation is thus achieved by the illustrative relay construction described in the foregoing. Upon the termination of the energizing current applied to winding 11 and the resulting collapse of its magnetic field, springs 21, 22, and 25 restore armature 16 to its normal rotational position.

A number of advantages are presented in the novel relay construction of the invention. A very close magnetic coupling is achieved between the pole-piece leg ends and the rotatable armature, one length of which is normally in contact with the leg ends. High operate speeds are thus made possible. Although, the mechanical advantage ratio between the movements of spring 35 and armature 16 is variable as the buckle of spring 35 increases, within the small contact gap to be traversed in practice, a 0.0023 inch armature movement resulted in a movement of 0.011 inch at the contact point of spring 35. The novel organization of the relay according to the invention also permits a reduction in size to allow a mounting density of 0.5 inch on centers.

Although in the foregoing the illustrative relay construction described contemplated a break-before-make mode of operation, it will be appreciated that the relay of the invention is considerably more versatile. A simple make operation, for example, may be achieved by eliminating spring 32 and contacts 34 and 39 or simply by leaving terminal pin 33 unconnected. A simple break switch operation may similarly be achieved by eliminating contacts 28 and 38 or simply by leaving terminal pin 29 unconnected. Accordingly, what has been described is considered to be only one specific illustrative relay construction according to the invention and it is to be understood that various and numerous other arrangements may be devised by one skilled in the art without departing from the spirit and scope of the invention as limited only by the accompanying claims.

What is claimed is:

1. Electrical relay apparatus comprising a pole-piece (14), a winding (11) coupled to said pole-piece (14), armature means (16), a fixed first contact (28), a spring member (35) fixedly mounted at one end, and a second contact (38) mounted on one side of said spring member (35) opposite to and spaced apart from said first contact (28) characterized in that said second contact (38) is mounted at near the midpoint of said spring member (35) between said one end and the opposite end, said pole-piece (14) being substantially "U" shaped to present a pair of legs (13, 15) presenting a first end and a second end of said pole-piece (14), said spring member being arranged between said pair of legs (13, 15) of said pole-piece (14), and in that said armature means (16) cooperates with said first end and said second end of said pole-piece (14) responsive to the energization of said winding (11) to apply a force to said opposite end of said spring member (35) in a direction toward said one end to bow said spring member (35) and thereby move said second contact (38) into engagement with said first contact (28).

2. Electrical relay apparatus as claimed in claim 1 further characterized in a fixed third contact (34) and a fourth contact (39) mounted at near the midpoint of said spring member (35) on the other side thereof opposite to and in engagement with said third contact (34), said third and said fourth contact (34, 39) disengaging when said spring member (35) is bowed.

3. Electrical relay apparatus comprising a pole-piece (14), a winding (11) associated with said pole-piece (14), armature means (16) cooperating with said pole-piece (14), a fixed first (16) contact (28), a spring member (35) fixedly mounted at one end, and a second contact (38) mounted on said spring member (35) opposite to and spaced apart from said first contact (28), characterized in that said pole-piece (14) is substantially "U" shaped to present a pair of parallel legs (13, 15) presenting a first end and a second end of said pole-piece (14), said winding (11) being coupled to one of said legs (13), said spring member (35) is arranged between said legs (13, 15) of said pole-piece (14), said second contact (38) is mounted on said spring member (35) at near the midpoint between said one end and the opposite end of said spring member (35), said spring member (35) is slightly bowed in the direction toward said first contact (28), said armature means (16) is pivotally arranged across said first and second ends of said pole-piece (14) so as to apply an operating force responsive to the energization of said winding (11) to said opposite end of said spring member (35) in a direction toward said one end, and in that said spring member (35) is further bowed by said operating force to move said second contact (38) into engagement with said first contact (28).

4. Electrical relay apparatus comprising a pole-piece (14), a winding (11) associated with said pole-piece (14), armature means (16) cooperating with said pole-piece (14), a fixed first contact (34), a spring member (35) fixedly mounted at one end, and a second contact (39) mounted on said spring member (35) opposite to and in engagement with said first contact (34), characterized in that said pole-piece (14) is substantially "U" shaped to present a pair of parallel legs (13, 15) presenting a first end and a second end of said pole-piece (14), said second contact (39) is mounted on said spring member (35) at near the midpoint between said one end and the opposite end of said spring member (35), said spring member (35) is slightly bowed in the direction away from said first contact (34), said armature means (16) is pivotally arranged across said first and second ends of said pole-piece (14) so as to apply an operating force responsive to the energization of said winding (11) to said opposite end of said spring member (35) in a direction toward said one end, and in that said spring member (35) is further bowed by said operating force to move said second contact (39) out of engagement with said first contact (34).

5. Electrical relay apparatus as claimed in claim 3 or 4 further characterized in that said armature means (16) is substantially "L" shaped to present a pair of flanges (17, 18), one of said flanges (17) resting across said first and second ends of said pole-piece (14).

6. Electrical relay apparatus as claimed in claim 5 further characterized in that said opposite end of said spring member (35) is provided with a rider member (40) having a lobe (41), the other of said flanges (18) of said armature means (16) operating against said lobe (41) to apply said operating force.

7. Electrical relay apparatus comprising a pole-piece (14), a winding (11) coupled to said pole-piece (14), armature means (16), a fixed first contact (34), a spring member (35) fixedly mounted at one end, and a second contact (39) mounted on one side of said spring member (35) opposite to and in engagement with said first contact (34) characterized in that said second contact (39) is mounted at near the midpoint of said spring member (35) between said one end and the opposite end, said pole-piece (14) being substantially "U" shaped to present a pair of legs (13, 15) presenting a first end and a second end of said pole-piece (14), said spring member being arranged between said pair of legs (13, 15) of said pole-piece (14), and in that said armature means (16) cooperates with said first end and said second end of said pole-piece (14) responsive to the energization of said winding (11) to apply a force to said opposite end of said spring member (35) in a direction toward said one end to bow said spring member (35) and thereby move said second contact (39) out of engagement with said first contact (34).

* * * * *

UNITED STATES PATENT AND TRADEMARK OFFICE

CERTIFICATE OF CORRECTION

PATENT NO. : 4,322,700

DATED : March 30, 1982

INVENTOR(S) : Billy M. Everhart and Harold E. McCullough

It is certified that error appears in the above–identified patent and that said Letters Patent are hereby corrected as shown below:

In the claims, Column 5, claim 3, line 11, after "first" delete --(16)--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*